US005307775A

United States Patent [19]

Ruthardt

[11] Patent Number: 5,307,775

[45] Date of Patent: May 3, 1994

[54] SPEED GOVERNOR FOR INTERNAL COMBUSTION ENGINES

[75] Inventor: Siegfried Ruthardt, Stuttgart, Fed. Rep. of Germany

[73] Assignee: Robert Bosch GmbH, Stuttgart, Fed. Rep. of Germany

[21] Appl. No.: 977,424

[22] PCT Filed: Jun. 10, 1992

[86] PCT No.: PCT/DE92/00480

§ 371 Date: Feb. 9, 1993

§ 102(e) Date: Feb. 9, 1993

[87] PCT Pub. No.: WO92/22739

PCT Pub. Date: Dec. 23, 1992

[30] Foreign Application Priority Data

Jun. 19, 1991 [DE] Fed. Rep. of Germany ..... 4120352

[51] Int. Cl.[5] ..... F02D 31/00

[52] U.S. Cl. ..... 123/366; 123/373

[58] Field of Search ..... 123/373, 382, 383, 366, 123/368, 179.17

[56] References Cited

U.S. PATENT DOCUMENTS

| | | | |
|---|---|---|---|
| 2,213,683 | 9/1940 | Banning | 123/366 |
| 2,902,018 | 9/1959 | Schlichtenmayer | 123/382 |
| 3,572,304 | 3/1971 | Becker | 123/366 |
| 3,577,968 | 5/1971 | Staudt | 123/368 |
| 3,640,259 | 2/1972 | Garcea | 123/366 |
| 3,699,941 | 10/1972 | Hughes | 123/366 |
| 4,204,510 | 5/1980 | Ritter | 123/366 |
| 4,223,653 | 9/1980 | Jaenke | 123/366 |
| 4,308,834 | 1/1982 | Eheim | 123/383 |
| 4,508,080 | 4/1985 | Nakamura | 123/373 |
| 4,782,804 | 12/1988 | Lehmann | 123/366 |

FOREIGN PATENT DOCUMENTS

| | | | |
|---|---|---|---|
| 2003927 | 8/1971 | Fed. Rep. of Germany | 123/366 |
| 1900675 | 10/1974 | Fed. Rep. of Germany . | |
| 3731241 | 3/1989 | Fed. Rep. of Germany | 123/373 |
| 0112425 | 9/1979 | Japan | 123/368 |
| 8703647 | 6/1987 | PCT Int'l Appl. . | |
| 1434387 | 5/1976 | United Kingdom | 123/366 |
| 2166565 | 5/1986 | United Kingdom . | |

*Primary Examiner*—Carl S. Miller
*Attorney, Agent, or Firm*—Michael J. Striker

[57] ABSTRACT

In all-speed governors controlled by centrifugal force and controlling the full-load fuel delivery quantity of the respective fuel injection pump as a function of boost pressure, the starting fuel delivery is to be reduced at higher operating temperatures of the internal combustion engine to prevent smoke bursts during warm starting. For this purpose, the speed governor has an added support provided in addition to a base support and supported of the later swivelably between two adjusting stops. In addition to a full-load stop arranged on the base support, the added support has an added stop which can be displaced by an adapter unit transversely to the swiveling direction as a function of the boost pressure.

16 Claims, 2 Drawing Sheets

SPEED GOVERNOR FOR INTERNAL COMBUSTION ENGINES

BACKGROUND OF THE INVENTION

The present invention relates to a speed governor for internal combustion engines.

More particularly, it relates to a speed governor for internal combustion engines having a centrifugal advance device which serves to regulate speed, acts against the force of governing springs, produces a speed-dependent adjustment path of a governor sleeve and is outfitted with centrifugal weights.

Such a speed governor is already known from DE-PS 19 00 675. This speed governor has an automatic spark advance or centrifugal advance device which generates an actuating force corresponding to the engine speed and acts via a control linkage on a control rod for controlling the quantity of fuel. A bracket is arranged between the control rod and control linkage, which control linkage terminates in a control lever. A feeler is supported at the connecting point between the control lever and bracket in such a way that it can be swiveled out in a springing manner. The feeler cooperates with a full-load stop. In so doing, the feeler senses a cam disk whose contour follows the fuel requirement of the internal combustion engine. The bracket transmits this movement to the control rod. A full-load fuel delivery quantity corresponding to the desired torque curve of the internal combustion engine is accordingly achieved.

To start the internal combustion engine, the feeler is brought into a position via the control linkage enabling it to swivel through under the full-load stop so that the control rod arrives in the starting position. The amount of fuel delivered by the fuel injection pump when starting exceeds the fuel quantity delivered at full-load since condensation losses in the combustion chambers of the cold internal combustion engine must be taken into account.

If the starting process is initiated when the internal combustion engine is already at operating temperature, the allotted starting fuel delivery is excessive because of the absence of condensation losses. The surplus fuel is incompletely burned and is emitted as a soot cloud. This so-called warm start smoke burst must be prevented in view of present strict requirements concerning exhaust quality.

SUMMARY OF THE INVENTION

Accordingly, it is an object of the present invention to provide a speed governor which avoids the disadvantages of the prior art.

In keeping with these objects and with others which will become apparent hereinafter, one feature of the present invention resides, briefly stated, in a speed governor for internal combustion engines, having a coupling between a fuel-quantity control member and the governor sleeve and enabling an optimal change in the fuel-injection quantity and formed by a control lever with the change its point of support via adjusting lever, wherein the inventive feature of the speed governor is that an added support for an added stop added stop is rotatably supported at a base support which is adjusted vertically by spacer plates and horizontally by dowel pin directly at the governor housing or indirectly at an actuating member connected with the governor housing, which added support is swivelable between two adjusting stops by the actuating member whose position depends on operating parameters of the internal combustion engine, and the added support is longitudinally displaceable transversely tot he swiveling direction by an adapter unit over the prior art that a warm start smoke burst is prevented when starting an internal combustion engine at operating temperature without changing the proportioning of fuel in other operating ranges of the internal combustion engine. Accordingly, low values of exhaust pollutants are achieved during warm starting and the specific output of the internal combustion engine can be increased with respect to fuel consumption.

In accordance with a further feature of the present invention, the adapter nit displaces the added stop as a function of the boost air pressure of the internal combustion engine and occupies apposition which is moved forward relative to the full-load control edge at a low-boost pressure and accordingly the added control edge, rather than the full-load control edge, lies in the detection range of the feeler.

When the governor is designed according to these features, the amount of fuel for warm starting can be allotted as a function of the boost air pressure of the internal combustion engine so that warm start smoke bursts can also be prevented in supercharged engines.

A simple and inexpensive actuating member whose adjusting path depends on the temperature is realized by using a memory spring.

The novel features of present invention which are considered as characteristic for the invention are set forth in particular in the appended claims. The invention itself, however, both as to is construction and its method of operation, together with additional objects and advantages thereof, will be best understood from the following description of specific embodiments when read in connection with the accompanying drawings.

DESCRIPTION OF PREFERRED EMBODIMENTS

Figure 1:
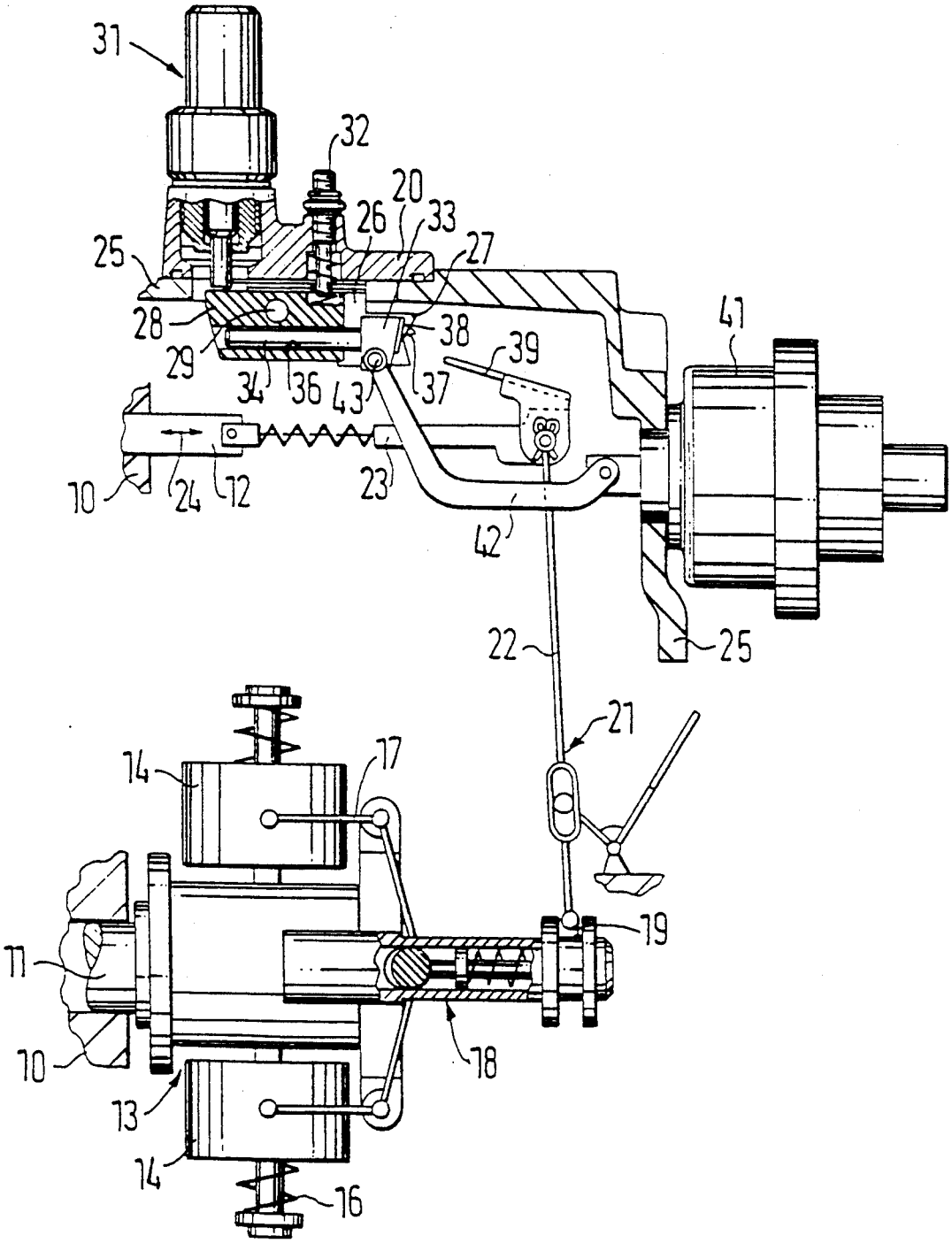
FIG. 1 shows a simplified view of a speed governor.

The substantial parts of an all-speed governor are shown in FIG. 1. The speed governor is mounted on a fuel injection pump, of Which only the housing 10, a camshaft 11 and a control rod 12 serving as fuel delivery control member are shown. The camshaft 11 is driven at a speed proportional to the speed of the internal combustion engine and drives a centrifugal advance device 13. The centrifugal advance device 13 has two centrifugal weights 14 which move out against the force of governing springs 16 under the influence of the centrifugal forces Which increase as the speed increases and actuate a governor collar 18 via angle levers 17.

The governor collar 18 is provided with an annular groove 19 in which one end of a control lever 22 engages as part of a control linkage 21, the other end of the control lever 22 being connected with a bracket 23 of the control rod 12.

The control rod 12 is displaceable in the adjusting direction 24 designated by a double arrow. A displacement to the left results in an increasing injection quantity (+) and a displacement toward the right results in a decreasing injection quantity (−). A base support 26 which has a full-load stop 27 constructed as a cam is adjustably fastened at a cover 20 arranged at the governor housing 25. An added support 28 is swivelably fastened at the base support 26 by an axle 29 fastened at the base support 26. The swiveling movement of the added support 28 is defined by two adjacent adjusting stops supported in the cover 20, namely an actuating member 31 and an adjusting screw 32 which lies opposite the actuating member 31 with reference to the axle 29.

The added support 28 has an added stop 33 with reference to the full-load stop 27, which added stop 33 is likewise constructed as a cam and is supported on a pin 34 so as to be longitudinally displaceable in a bore hole 36 Which is arranged at a right angle relative to the axle 29 on the one hand and to the actuating member 31 and adjusting screw 32 on the other hand. Control edges, a full-load control edge 37 on the one hand and an added control edge 38 on the other hand, are constructed at the full-load stop 27 and at the added stop 33 at the front, remote of the bore hole 36.

The two control edges 37, 38 can be acted upon in a positive-locking manner by a feeler 39. One end region of the feeler 39 is arranged approximately at a right angle to the alignment of the control edges 37, 38 and its other end region is connected with the control lever 22. The position of the feeler 39 influences the position of the control lever 22 and accordingly indirectly influences the fuel injection quantity.

As a result of the displacement of the pin 34 in the bore hole 36, the added stop 33 can be brought into a position in which it determines the position of the feeler 39 with its added control edge 38 instead of the full-load control edge 37. The added stop 33 is guided by an adapter unit 41 which is fastened at the governor housing 25 and whose adjusting movement is transmitted to the added stop 33 as a function of the boost air pressure of the internal combustion engine via an intermediate lever 42 at a wrist pin 43.

Figure 2:
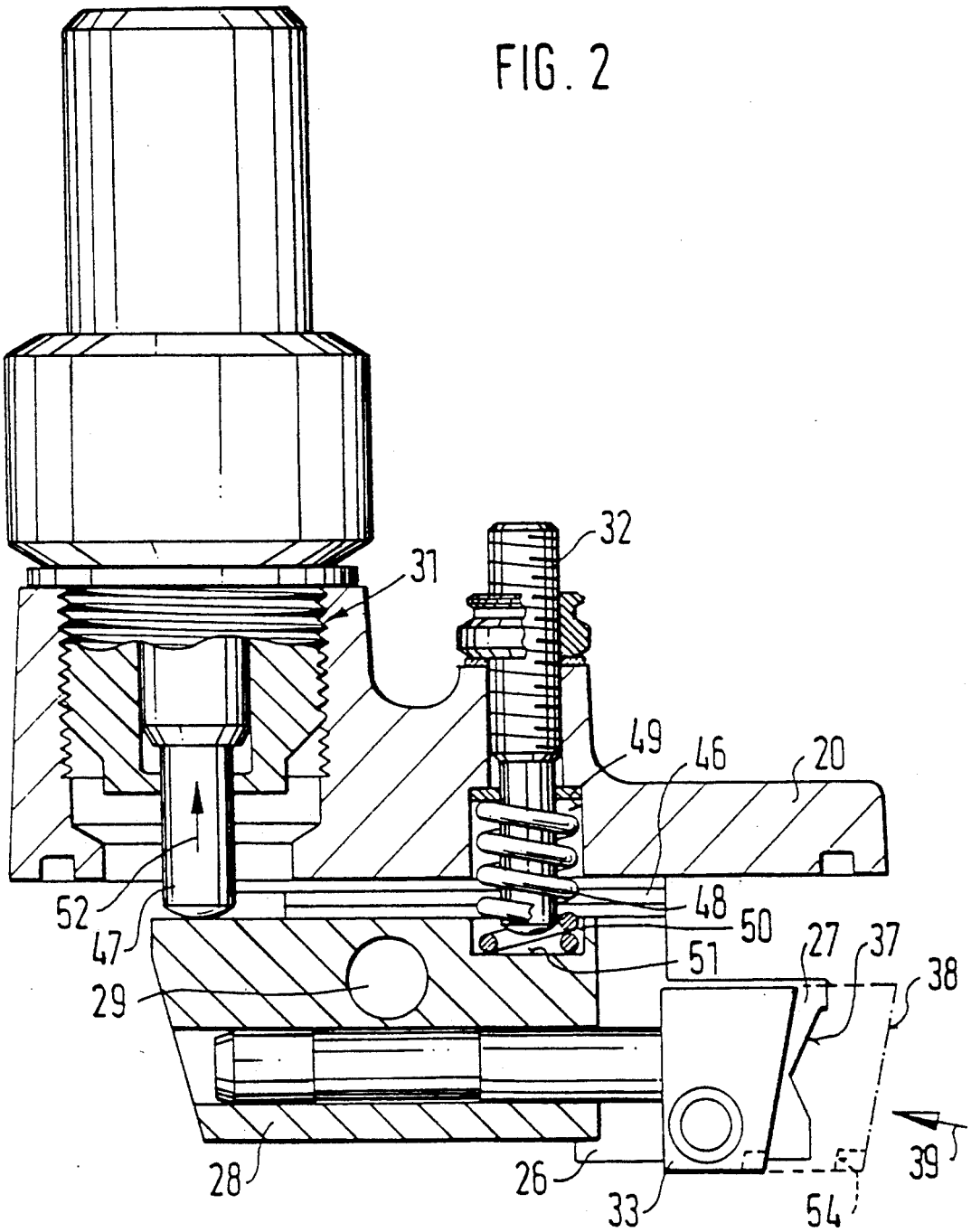
FIG. 2 shows a partial section of the speed governor with stops for the fuel allotment in full-load operation, and an actuating member.

According to FIG. 2 the base support 26, which is fastened at the cover 20 in a manner not shown in the drawing, is positioned vertically by spacer plates 46 which are inserted between the governor housing 25 and the cover 20 and serve to compensate for tolerances, while the horizontal positioning is effected via dowel pins, not shown.

The actuating member 31 and the adjusting screw 32 are received in the cover 20 in the vertical direction. The actuating member 31 is constructed as a temperature-controlled expansion element and has a tappet 47 at its end which is supported on the base support 26 and transmits the vertical adjusting movement of the actuating member 31.

The added support 28 follows the adjusting movements of the actuating member 31 against the restoring force of a spring 48 which lies opposite the tappet 47 with reference to the axle 29.

The spring 48 is received in a bore hole 49 of the cover 20 and in a recess 50 of the added support 28 which lies flush with the bore hole 49.

The swiveling movement of the added support 28 against the adjusting force of the spring 48 is defined by the stop of the adjusting screw 32 on a base surface 51 of the recess 50. The adjusting screw 32 is constructed as an adjusting screw which can be tightened and serves for the vertical positioning of the added control edge 38 during the starting process of the internal combustion engine which is at cold operating temperature. This so-called cold start which occurs at temperatures below the freezing point is connected with a vertical displacement of the tappet 47 opposite the direction of arrow 52. The added support 26 accordingly swivels in the counterclockwise direction until the adjusting screw 32 contacts the base surface 51. This position is designated as cold start locking. In so doing, the added sensing surface 38 is displaced vertically in the direction of arrow 52 in such a way that it is located outside the detection range of the feeler 39, which is only shown schematically in FIG. 2, and the feeler 39 passes through under the added control edge 38 so as to arrive in a starting position defined by a starting fuel delivery stop, not shown, in order to achieve the increased allotment of fuel required for cold starting. This process is designated as start release.

FIG. 2 shows the added stop 33 in its two possible end positions. When the internal combustion engine is not in operation or is in the lower speed range, the added stop 33 is in the position shown in dash-dot lines and thus closest to the position of the feeler 39 shown in the drawing. Since the full-load fuel delivery is adapted to the boost pressure in supercharged engines, the boost pressure is low in the lower speed range and the weight of the air filling the engine cylinders is accordingly also low. Therefore, the full-load fuel delivery quantity must also be adapted to the reduced air weight in a corresponding ratio. The contour of the added control edge 38 serves this purpose.

If the internal combustion engine is warmed up to operating temperature after the cold start and is restarted after a brief pause, this is a warm start. The tappet 47 is displaced in the direction of arrow 52 during a warm start and the added stop 33 is swiveled under the influence of the spring 48 in such a way that the added control edge 38 lies in the detection range of the feeler 39 and the feeler 39 comes to rest at the added sensing surface 35. This position is designated as the suction regulating position, in which there is no boost pressure, and results in a starting fuel delivery which is reduced relative to the cold start in such a way that all of the proportioned fuel can be burned and an emission of incompletely burned fuel forming a so-called warm start smoke burst is prevented.

However, there are also constructions of supercharged engines which cannot yet be started with the fuel quantity associated with the suction regulating position. For these engines, the added control edge 38 has an auxiliary control edge 54. This auxiliary control edge 54 is shown in dots in FIG. 2 and is set back relative to the added control edge 38 far enough so that the feeler 39 arrives in a position during warm starting which results in an increased allotment of fuel relative to the suction regulating position which is great enough to allow these engines to be started.

After the internal combustion engine is started, the added stop 33 can be adjusted by the adapter unit 41 at high loads corresponding to a high boost pressure until its added control edge 38 moves back with respect to the feeler 39 until the feeler 39 comes into contact with the stationary full-load control edge 37 of the full-load stop 27 and the full-load fuel delivery quantity is determined in this operating state of the fuel injection pump by the configuration of the full-load control edge 37.

As an alternative to the embodiment example described and shown in the preceding, the actuating member 31 is replaced in a second embodiment example by the spring 48 and a memory spring is used instead of the original spring 48. The memory spring has the characteristic that its spring constant changes as a function of temperature. Accordingly, different force ratios are possible with reference to the spring 48 replacing the actuating member 31. During a cold start, the spring force of the spring 48 is greater than the spring force of the memory spring. The ratios are reversed during a warm start. This leads to different swiveling positions of the added stop 33 as a function of temperature and enables the same starting processes as in the preceding embodiment example.

In another alternative solution, a memory spring is used in the same manner as already described, but not an adapter unit 41 as in the preceding embodiment example. The support of the added stop 33 is accordingly changed and this added stop 33 is no longer guided by the intermediate lever of the adapter unit 41, but rather is secured at the support by spring pressure. This arrangement enables the same adjusting processes as described above, but without the boost pressure function of the adapter unit 41.

With the embodiment example shown and described in the preceding it is possible to prevent warm start smoke bursts in speed governors of the generic type and, with control members 31, 41 having small adjusting paths, to achieve a large control position differential. This makes it possible to achieve low values in exhaust pollutants during a warm start.

It will be understood that each of the elements described above, or two or more together, may also find a useful application in other types of constructions differing from the types described above.

While the invention has been illustrated and described as embodied in a speed governor for internal combustion engines, it is not intended to be limited to the details shown, since various modifications and structural changes may be made without departing in any way from the spirit of the present invention.

Without further analysis, the foregoing will so fully reveal the gist of the present invention that others can, be applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A speed governor for internal combustion engines, comprising a fuel-quantity control member; a governor sleeve; a centrifugal advance device operated for regulating speed and producing a speed-dependent adjustment of said governor sleeve; a coupling provided between said governor sleeve and said fuel-quantity control member and enabling an optional change in a fuel injection quantity, said coupling including a control lever provided with a feeler; a base support provided with a full-load stop which can be sensed by said feeler of said control lever; and added support provided with an added stop and rotatably supported at said base support; a governor housing on which said base support is fixed; means for fixing said base support on said housing; two adjusting stops; an actuating member which swivels said added support between said adjusting stops and has a position depending on operating parameters of the internal combustion engine; an adapter unit longitudinally displacing said added support transversely to the swiveling direction.

2. A speed governor as defined in claim 1; and further comprising governing springs against which said centrifugal advance device acts; and centrifugal weights provided on said centrifugal advance device.

3. A speed governor as defined in claim 1, wherein in said fixing means includes spacer plates for vertically fixing said base support and dowel pins for horizontally fixing said base supports.

4. A speed governor as defined in claim 1, wherein said base support is directly fixed at said governor housing.

5. A speed governor as defined in claim 1, wherein said actuating member is connected with said governor housing, said base support being fixed at said actuating member.

6. A speed governor as defined in claim 1, wherein said added stop has an added control edge which can be acted upon by said feeler which influences said fuel-quantity control member.

7. A speed governor as defined in claim 1, wherein said actuating member is formed so that it changes its position as a function of temperature.

8. A speed governor as defined in claim 1; and further comprising a pin which is supported in said added and can displace said added stop longitudinally.

9. A speed governor as defined in claim 8, wherein said pin displaces said added stop vertically with respect to an adjusting direction of said actuating member.

10. A speed governor as defined in claim 6; and further comprising an axle which is fixed in said base support, said added control edge can be displaced out of the detection range of said feeler by said actuating member by rotation of said added support around said axle and said displacement occurs at a cold starting temperature, said feeler being swivelable through under said added control edge, and limiting of an increased fuel quantity allotment connected with said movement is effectd by a starting fuel delivery stop.

11. A speed governor as defined in claim 9, wherein said added control edge is formed so that said displacement occurs at said cold starting temperature which is at most equal to a freezing point for water.

12. A speed governor as defined in claim 1, wherein said adapter unit is formed to transmit adjusting movement to said added stop.

13. A speed governor as defined in claim 6, and further comprising a full-load control edge, said adapted unit being formed first to displace said added stop as a function of a boost air pressure of the internal combustion engine and occupies a position which is moved forward relative to said full-load control edge at a low boost pressure, so that said added control edge, rather than said full-load control edge, lies in a detection range of said feeler.

14. A speed governor as defined in claim 6, and further comprising a starting fuel delivery stop, said added control edge being formed so as to limit the swiveling movement of said feeler in the direction of said starting fuel delivery stop during a starting process at temperatures higher than a cold starting temperature.

15. A speed governor as defined in claim 6; and further comprising an auxiliary control edge provided at said added control edge and permitting said feeler a swiveling in position enabling an increase fuel allotment when said feeler stops at said auxiliary control edge.

16. A speed governor as defined in claim 1, wherein said actuating member is formed as a temperature-dependent memory spring.

* * * * *